US009842576B2

(12) United States Patent
Giansante

(10) Patent No.: US 9,842,576 B2
(45) Date of Patent: Dec. 12, 2017

(54) MIDI MALLET FOR TOUCH SCREEN DEVICES

(71) Applicant: Anthony Giansante, Kelowna (CA)

(72) Inventor: Anthony Giansante, Kelowna (CA)

(73) Assignee: Anthony Giansante, Kelowna, British Columbia (CA)

( * ) Notice: Subject to any disclaimer, the term of this patent is extended or adjusted under 35 U.S.C. 154(b) by 0 days.

(21) Appl. No.: 14/955,498

(22) Filed: Dec. 1, 2015

(65) Prior Publication Data

US 2017/0154616 A1 Jun. 1, 2017

(51) Int. Cl.

| | |
|---|---|
| ***G10H 1/32*** | (2006.01) |
| ***G10H 1/00*** | (2006.01) |
| ***G10H 3/14*** | (2006.01) |

(52) U.S. Cl.

CPC ..... *G10H 1/32* (2013.01); *G10H 1/0066* (2013.01); *G10H 3/146* (2013.01); *G10H 2220/401* (2013.01); *G10H 2220/561* (2013.01)

(58) Field of Classification Search

CPC ..... G10H 1/32; G10H 1/0066; G10H 3/146; G10H 2220/561; G10H 2220/401

USPC ..... 84/644

See application file for complete search history.

(56) References Cited

U.S. PATENT DOCUMENTS

| | | | | |
|---|---|---|---|---|
| 5,009,146 | A * | 4/1991 | Manabe | G10H 1/055 84/615 |
| 2011/0132181 | A1* | 6/2011 | Kockovic | G10H 1/34 84/723 |
| 2013/0152768 | A1* | 6/2013 | Rapp | G10H 3/125 84/634 |
| 2016/0203807 | A1* | 7/2016 | Hardi | G10D 13/003 84/600 |
| 2016/0247495 | A1* | 8/2016 | Dourmashkin | G10H 1/34 |

* cited by examiner

*Primary Examiner* — Jeffrey Donels

(57) ABSTRACT

For music production, the velocity values with the purpose of creating dynamic percussion in cooperation with a value measuring surface (a touch screen tablet or touch screen phone) has the ability to simulate the tension of a percussion instrument thus tone values are correlated with X, Y values from a measuring surface and dynamics values are measured with velocity, all inclusive, wireless and cooperative with MIDI software.

2 Claims, 6 Drawing Sheets

MIDI MALLET FOR TOUCH SCREEN DEVICES

CROSS REFERENCE TO RELATED APPLICATIONS

US Patent Documents

Figure 1A:
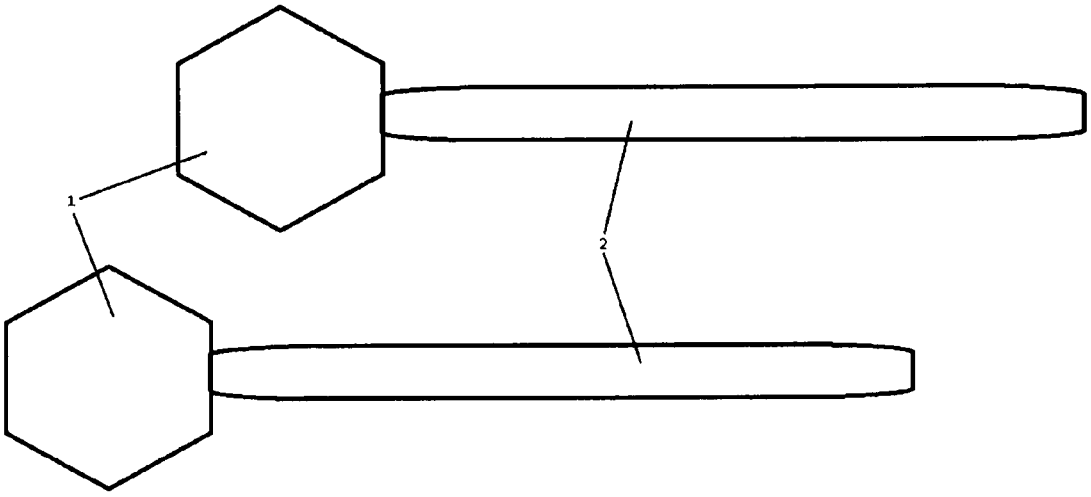

U.S. Ser. No. 06/665,781 15-1986 Yoshiki Hoshino
U.S. Pat. No. 5,009,146 A April 1991 Manabel Hajime
U.S. Pat. No. 5,471,008 A November 1995 Akihiro Fujita, Seiji Nakano, Katsushi Ishii
US-2011/0132181 A1 June 2011 Kockovic; Neven
US-2013/0152768 A1 June 2013 Rapp; John W.
US-2016/0203807 A1 July 2016 Nardi; Jason
US-2016/0247495 A1 August 2016 Dourmashkin; Steven

STATEMENT REGARDING FEDERALLY SPONSORED RESEARCH OR DEVELOPMENT

NOT APPLICABLE

NAMES OF THE PARTIES TO A JOINT RESEARCH AGREEMENT

NOT APPLICABLE

INCORPORATION-BY-REFERENCE OF MATERIAL SUBMITTED ON A COMPACT DISC OR AS A TEXT FILE VIA THE OFFICE ELECTRONIC FILING SYSTEM

NOT APPLICABLE

STATEMENT REGARDING PRIOR DISCLOSURE BY THE INVENTOR OR A JOINT INVENTOR

NOT APPLICABLE

BACKGROUND OF INVENTION

(1) Field of Invention

The present invention relates to electronic music production for the purpose of creating a realistic simulation of percussion. Focused mainly on the dynamics, timbre, resonance, and tone of a percussion instrument, this invention focuses on giving the user control of these effects using wireless technology to send digital signals.

(2) Description of Related Art

Electronic drums have been used and are currently used in many aspects of music production.

They fall into two categories:

(A) Button FSR Midi Controllers (B) Surface Measuring Electronic Drums

In essence the fore mentioned invention combines the two ideas, allowing the feel of playing a drum as with (B) and the digital control as with (A).

Electronic drums that are button FSR midi controller (A) commonly referred to as drum machines operate like a keyboard, where force is measured with a force sensitive resistor and a MIDI signal is sent to the computer.

An example of a drum machine is in the following patent application:

(1) MIDI Control Apparatus, U.S. Pat. No. 5,471,008 A, Akihiro Fujita, Seiji Nakano, Katsushi Ishii Electronic drums that are Surface Measuring Electronic Drums (B) have a special surface that allows the user to use a drum stick and play electronic drums as a normal instrument with sound recordings pre-loaded onto the drum and triggered by striking the surface.

An example of a surface measuring electronic drum is in the following patent application:

(2) U.S. Ser. No. 06/665,781 15-1986 Yoshiki Hoshino

None of the above mentioned inventions are optimized for the use of touchscreen devices while category (A) does send velocity signals it fails to give the user the feel of playing a real percussive instrument, category (A) also does not optimize the use of touchscreen devices to mimic the tension of a drum. Category (B) does allow the user to mimic tension but it also does not optimize the use of a touch screen device or send MIDI signals to music production software. Neither of these categories are inclusive, wireless, force measuring devices that work in coordination with touch screen devices to simulate real percussion instruments.

BRIEF SUMMARY OF INVENTION

The invention relates to electronic music production, where a small micro controller, a small Bluetooth chip, and a force sensitive resistor have been encased in a xylophone shaped mallet for the purpose of measuring the force when the mallet strikes a surface. The invention has been optimized for a touch screen device such as a tablet or touchscreen phones; when the fore mentioned touchscreen device is struck with the mallet a value based on where the touch screen device was struck is generated and a digital value from the velocity at which it was struck is generated.

A BRIEF DESCRIPTION OF SEVERAL VIEWS OF THE DRAWING

Figure 1B:
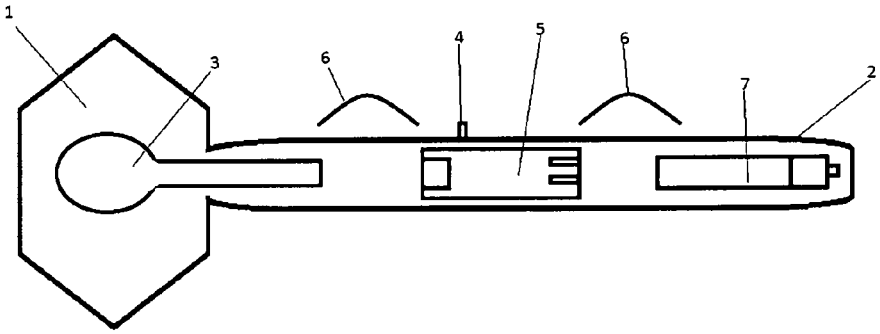
Figure 2A:
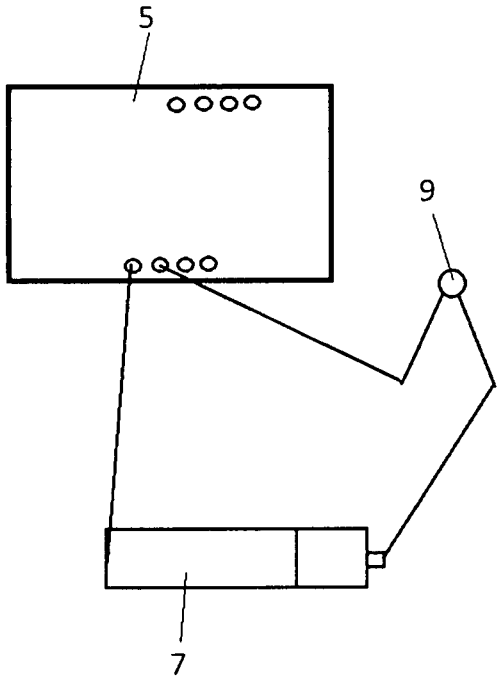
Figure 2B:
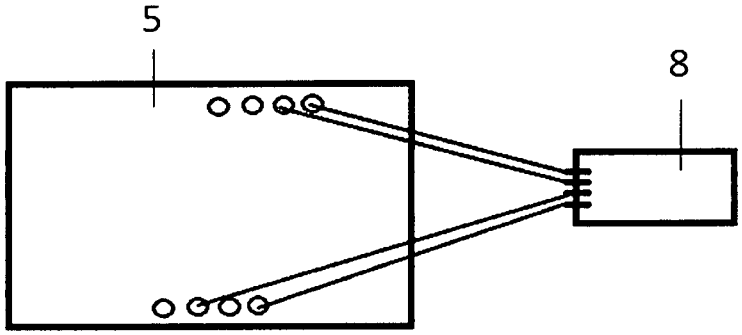
Figure 2C:
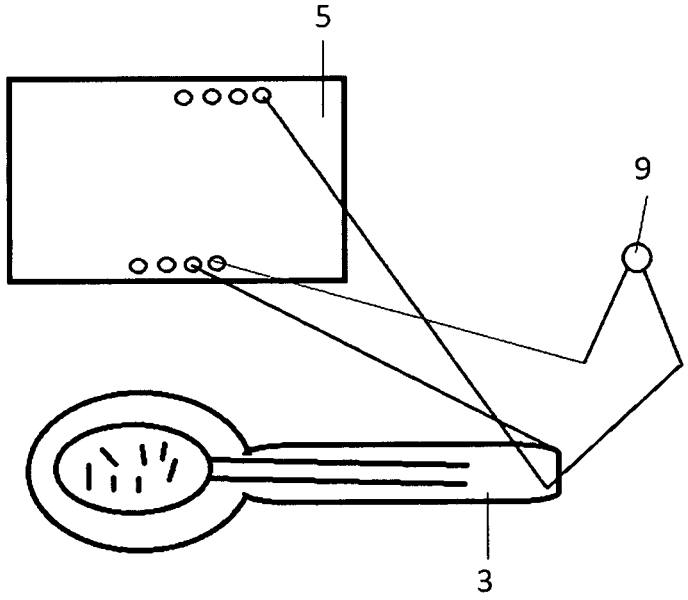
Figure 3A:
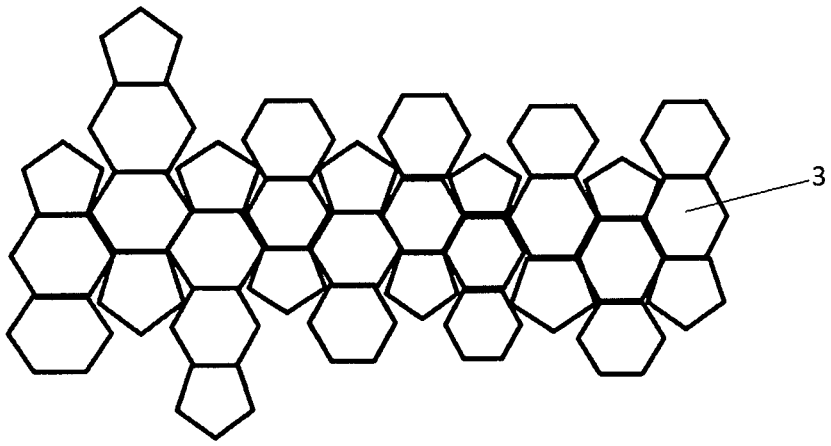
Figure 3B:
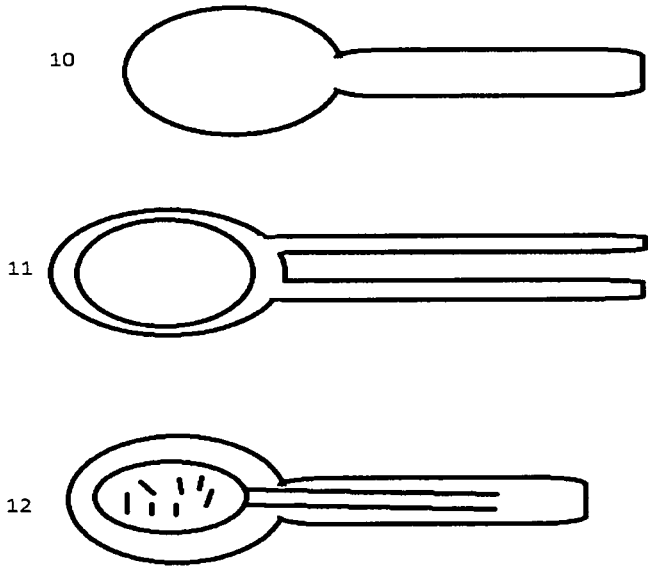
Figure 3C:
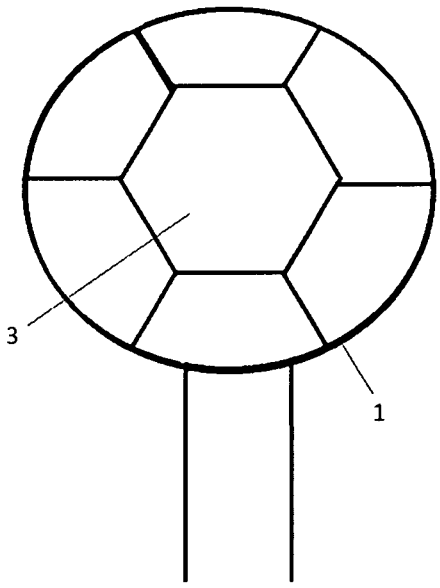
Figure 4:
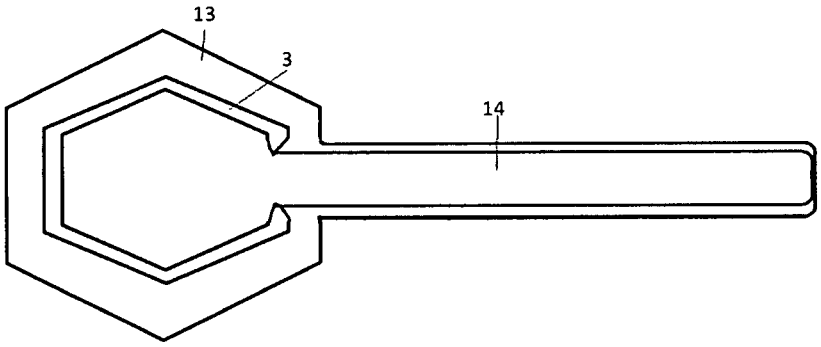
Figure 5A:
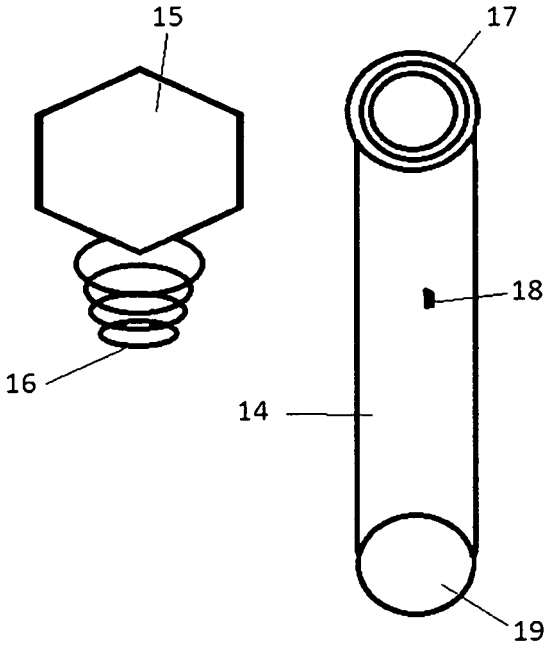
Figure 5B:
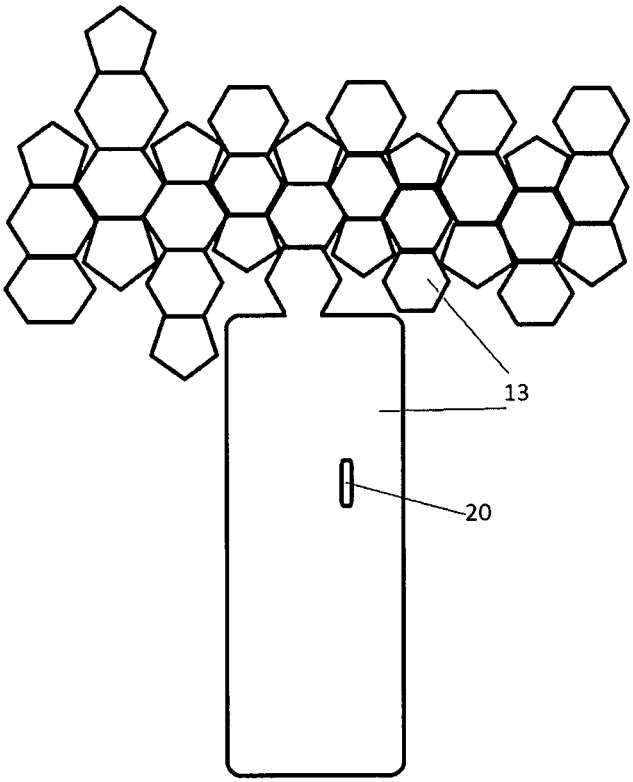

FIG. 1*a*-Overview of the midi mallet with a spherical head and a cylindrical base FIG. 1*b*—The inner composition consisting of a battery, a micro controller, and a force sensitive resistor FIG. 2*a*—Circuitry of the micro controller to the power source FIG. 2*b*—Circuitry of the micro controller to the Bluetooth Chip FIG. 2*c*—Circuitry of the micro controller to the Force sensitive resistor FIG. 3*a*—Linear shape diagram of the Force Sensitive Resistor FIG. 3*b*—Spherical shape diagram of the Force Sensitive Resistor FIG. 3*c*—Overview of a Force Sensitive Resistor FIG. 4—Layered Diagram of the MIDI Mallet FIG. 5*a*—Interior core of the Midi Mallet and components FIG. 5*b*—Exterior conductive wrap

THE MIDI MALLET

FIG. 1*a* is an overview of the invention FIG. 1*a* (1) is the head of the mallet which contains the force sensitive resistor and FIG. 1*a* (2) is the base which contains the circuitry and battery.

The Circuitry

FIG. 1*b* show the inner workings of the MIDI mallet, FIG. 1*b* (7) show the AAAA battery, which is attached by a conductive wire FIG. 1*b* (6) which is attached to an Arduino Micro controller FIG. 1*b* (5) with Bluetooth FIG. 2*b* (8) which attaches to a Force Sensitive Resistor FIG. 1*b* (3).

The Design

The core of the Midi Mallet (FIG. 5*a*) is composed to two separate pieces, the top mallet core FIG. 5*b*(15) which contains a male screw helix FIG. 5*a*(16) and the base piece FIG. 5*b*(14) which contains a female screw helix FIG. 5*a*(17) a hole for an on/off switch FIG. 5*b*(18) and a sliding battery door compartment FIG. 5*a*(19).

The mallet core FIG. 5*a* (14) is overlapped with a force sensitive resistor FIG. 4 (3)/FIG. 3*c*/FIG. 3*a* and attached with a small amount of glue.

The outer conductive layer FIG. 4 (13), FIG. 5*b* (13) is a thin wrap made of an electrically conductive anti-static plastic that conducts electricity; alternatively it can also be a thin plastic wrap FIG. 5*b* (13) coated with conductive ink.

DETAILED DESCRIPTION OF THE INVENTION

The present invention has been made to optimize the use of a touch screen device in professional music production. The current limitations of previous inventions are as follows: devices are large, bulky and must be connected through a USB port. Devices are unable to recreate an effective drum tension that otherwise creates the subtle tone of a drum and USB MIDI controllers play more like a piano than a drum.

An object of the present invention is that it is designed to work with a touch screen device which eliminates the use of a bulky box or surface measuring device and at the same time gives the user more control of the subtle dynamics of percussion. Another object of the current invention is the wireless capabilities and that it is battery powered.

A further object is that it not only replicates the timber and tone of a real drum, it plays like a real drum in the sense that you are striking something with a mallet.

For the fore mentioned invention to adequately simulate a real drum it must work in cooperation with a touch screen device, and a specific software designed with preloaded musical recordings which are called samples that are triggered based on a 3 dimensional grid.

The 3 dimensional grid consist of an X and Y coordinate which is based on where the mallet touches the touch screen device and a Z coordinate which is dictated based on the force in which the device is struck. All combined X, Y and Z allows for a larger amount of different samples to be triggered.

SEQUENCE LISTING

NOT APPLICABLE

The invention claimed is:

1. An electronic percussion instrument, comprising:

a casing in the shape of a mallet;

force sensitive resisting sensors that encapsulate the top of the mallet and produce a generated electrical conductivity value when applied with pressure;

a programmed microcontroller which calculates a force measurement from the generated electrical conductivity value and outputs a MIDI value through a Bluetooth wireless signal;

a personal computer running a software program that receives the MIDI value.

2. An electronic percussion instrument as aforementioned in claim 1 has an electrically conductive coating that covers the entire outer casing of the mallet.

* * * * *